United States Patent [19]

Leonhart

[11] 4,392,685

[45] Jul. 12, 1983

[54] COMBINED LAWN CHAIR AND TABLE RECLINER

[76] Inventor: Franz X. Leonhart, 8385 Harburg, near 8385 Pilsting, Fed. Rep. of Germany

[21] Appl. No.: 228,160

[22] Filed: Jan. 23, 1981

[30] Foreign Application Priority Data

Jan. 28, 1980 [DE] Fed. Rep. of Germany ..... 3002926

[51] Int. Cl.[3] ..... A47B 85/02; A47C 7/50

[52] U.S. Cl. ..... 297/119; 297/174; 297/429; 297/320

[58] Field of Search ..... 297/429, 172, 30, 423, 297/440, 118, 119, 174, 173, 135, 431, 432

[56] References Cited

U.S. PATENT DOCUMENTS

| | | | |
|---|---|---|---|
| 73,416 | 1/1868 | White | 297/174 |
| 167,095 | 8/1875 | Goss | 297/431 |
| 576,344 | 2/1897 | Eccleston | 297/431 |
| 614,666 | 11/1898 | Petry | 297/431 |
| 2,555,144 | 5/1951 | Londerman et al. | 297/119 |
| 2,658,562 | 11/1953 | Androsiglio | 297/173 X |
| 4,311,337 | 1/1982 | Brunn | 297/440 |

*Primary Examiner*—Francis K. Zugel

*Attorney, Agent, or Firm*—Brady, O'Boyle & Gates

[57] ABSTRACT

An adjustable lawn armchair is connected to one end of a pair of longitudinally extending spaced side members, and a footrest portion is connected to the other end thereof. Articulated pairs of supporting legs connect the footrest portion adjustably to spaced grooves in the pair of side members, whereby the footrest portion can be adjusted in its height and inclination to form a raised table in front of the armchair and can be lowered and shifted in the longitudinal direction together with adjustment of the seat and back of the armchair to form a recliner.

3 Claims, 6 Drawing Figures

COMBINED LAWN CHAIR AND TABLE RECLINER

BACKGROUND OF THE INVENTION

The invention relates to a lawn recliner which is an adjustable lawn armchair with a vertically adjustable footrest that converts into an adjustable table for use with the armchair.

It is known to combine an adjustable armchair additionally with a vertically adjustable footrest, and to fashion the footrest proper as a children's table or children's bench.

The object of the present invention is to open up still further usage possibilities for an armchair, with the use of a vertically adjustable footrest.

SUMMARY OF THE INVENTION

This object has been attained according to the invention by connecting the chair and the footrest by a pair of longitudinally extending side members and by constructing the footrest portion, in that portion of the side members in front of the chair portion, as a vertically adjustable table to be displaceable in the longitudinal direction relative to the chair portion.

This is realized in a simple way, for example, by providing the two longitudinally extending side members of the armchair at their foot end portions and on their inner facing sides with respectively two longitudinally extending grooves spaced one above the other, and are joined in front of the foot end of the side members by means of a substantially vertically extending cross groove. Pivots are provided at the lower ends of the feet of the table which protrude laterally from the sides of the table feet into sliding engagement in the grooves of the side members, wherein one pair of pivots, namely the one lying at the foot end of the side members, is fashioned as a continuous cross rod.

The details and operation of the invention are set forth in greater detail in the specification hereinafter following by reference to the accompanying drawings.

DESCRIPTION OF THE PREFERRED EMBODIMENT

Figure 1:
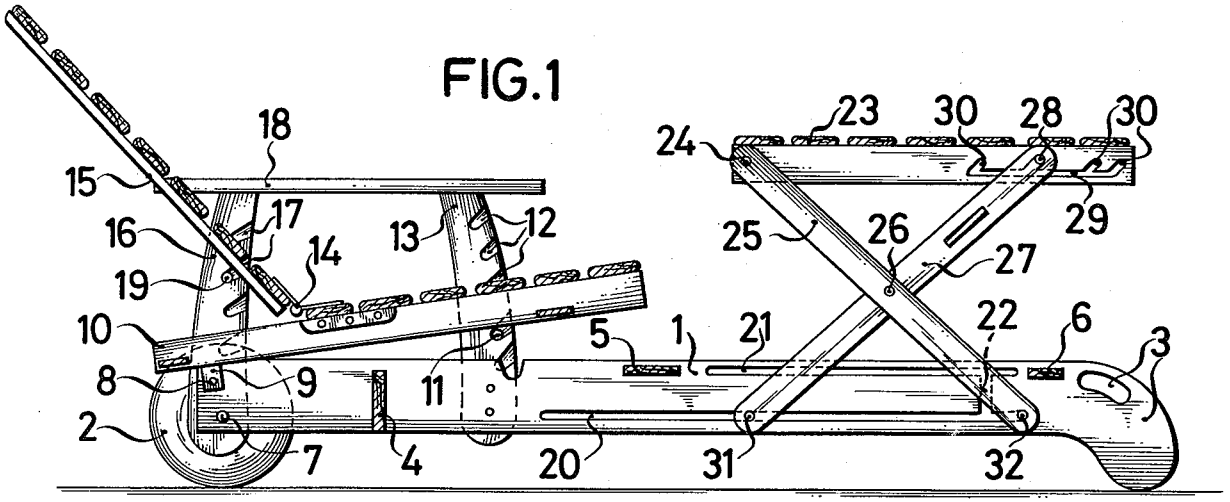
FIG. 1 is a vertical longitudinal sectional view of the lawn chair and table recliner according to the invention.

The combined adjustable armchair and table recliner of this invention, of the type generally used on a lawn but which can also be used elsewhere, consists of a conventional type base of longitudinally extending spaced side members 1 arranged on edge and made of wood, with a wheel 2 and a handle 3 at opposite ends of each side member 1, forming a solid base frame together with connecting crossbars 4–6. An iron strap 9 is articulated above the wheel axle 7 at 8 to side member 1, this strap being firmly connected to a seat surface 10 for the chair portion of the assembly. The front part of the seat surface 10 rests on and is supported by a cross rod 11 which can be selectively inserted in and removed from a selected one of plural half-deep grooves 12 on the inner sides of front arm supports 13. At the rear end of the seat surface 10, two hinges 14 are mounted which are connected with the lower end of a chair backrest 15. A pair of rear arm supports 16 with plural half-deep grooves 17 therein, together with the pair of front arm supports 13, carries the armrests 18 on opposite sides of the base frame. A separate rod 19, which can be selectively introduced into and removed from the half-deep grooves 17 in the rear arm supports, retains the backrest 15 in various, selectable reclining positions.

In the foot portion of the side members 1, mutually parallel pairs of half-deep longitudinally extending grooves 20, 21, spaced one above the other, are milled in, on the inwardly facing side surfaces, which grooves are joined adjacent the foot end by a short connecting cross groove 22.

The table portion of the recliner consists conventionally of a tabletop 23; at 24, the upper end of a pair of supporting legs 25 is articulated to the rear end of the tabletop. Approximately in the center of the supporting legs 25, a second pair of supporting legs 27 is mounted by articulation at 26. The upper end of each second supporting leg 27 has an outwardly projecting stud 28 slideably engaging into a longitudinal groove 29 with lateral adjustment stop branches 30, on the bottom supports of the table top 23.

Figure 2:
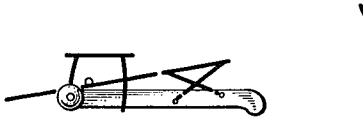
FIGS. 2–6 are schematic views, on a smaller scale, showing the armchair with the table according to the invention in various adjusted positions of the individual parts.

The lower ends of the supporting legs 25, 27 have outwardly projecting pivot studs 31, 32, wherein the pivot studs 32 form the ends of a continuously extending lateral rod. By lifting this lateral rod with the tips of one's feet while sitting in the chair portion, the pivot studs 32 can be inserted in the upper longitudinal groove 21, through the cross groove 22, whereby the table assumes a desk-like inclination dropping toward the seat, as shown in FIGS. 2 and 5.

Figure 4:
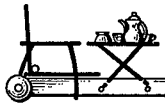
Figure 5:
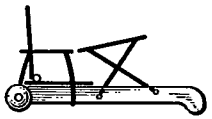

According to FIGS. 1, 4 and 5, the table can be readily shifted longitudinally in grooves 20 and 21, whereby in the extreme adjusted position toward the handle 3 in the side members, entering onto the seat of the chair is facilitated, and the table can then be pulled longitudinally toward one's body as indicated in FIGS. 4 and 5, for eating or reading purposes.

Figure 3:
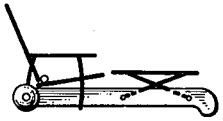

In accordance with FIG. 3, with the armchair in a lounge position as shown in FIG. 1, the table top 23 can be lowered to an intermediate horizontal position to form a raised leg and footrest thus converting the assembly to a recliner or lounge. It should be appreciated that many variations and combinations of recliner positions can be obtained including one with a completely flat inclined surface as shown in FIG. 2, when backrest 15 is lowered into the same plane as the seat 10, the seat 10 with the backrest is then raised to the position shown in FIG. 1, and the table is lowered to an intermediate height position as previously described and shifted longitudinally toward the seat to form a substantially continuous inclined surface.

Figure 6:
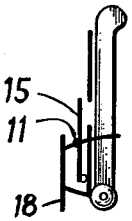

In the storage position of the combined armchair-table lounge according to FIG. 6, the cross rod 11 retains all parts in the illustrated folded position. Referring to FIG. 1, studs 28 are moved into the adjustment stop branch to the extreme right in FIG. 1, so that the table is completely folded such that the table top 23 is in the flat lounge position with its bottom supports resting on crossbars 5 and 6. Cross rod 11 is then removed and seat 10 is folded flat so its front edge is supported on crossbar 5, with the top of seat 10 and table top 23 being coplanar in the flat lounge position. Chair backrest 15 is then folded flat on top of seat 10 and a portion of table top 23, and cross rod 11 is inserted into the appropriate grooves 12 to retain the backrest 15 in the folded position locking all of the other elements together. The folded recliner can then be stored on end as shown in FIG. 6 stabilized by the rear ends of armrests 18.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. An adjustable recliner chair with a footrest, comprising a pair of longitudinally extending spaced side members (1) having inwardly facing inner surfaces forming a base frame, an adjustable chair assembly (10,15) connected to one end of said side members, a footrest portion (23), vertically adjustable means (24–32) connected with said side members in front of said chair assembly and with said footrest portion, two longitudinal spaced grooves (20,21) on each inner surface extending from substantially in front of said chair assembly to adjacent the opposite end of said side members (1), a cross groove (22) connecting the two longitudinal spaced grooves in front of the ends thereof adjacent said opposite end of the side members, said vertically adjustable means (24–32) having lower ends, and pivot studs (31,32) protruding from the lower ends of said vertically adjustable means and engaged in said grooves on the inner surfaces, whereby said vertically adjustable means are longitudinally displaceable on said side members for vertically adjusting said footrest portion to form a raised table.

2. An adjustable recliner chair as set forth in claim 1, in which said vertically adjustable means (24–32) includes scissor legs having upper ends connected with said footrest portion and lower ends carrying said pivot studs (31,32).

3. An adjustable recliner chair as set forth in claim 1, in which said pivot studs comprise pairs of pivot studs (31,32), said vertically adjustable means (24–32) including table legs having lower ends, and one pair of said pivot studs (32) located adjacent said opposite end of said side members (1) comprising a continuous lateral rod.

* * * * *